US007074284B2

(12) United States Patent
Nazmy et al.

(10) Patent No.: US 7,074,284 B2
(45) Date of Patent: Jul. 11, 2006

(54) HEAT TREATMENT METHOD FOR BODIES THAT COMPRISE A NICKEL BASED SUPERALLOY

(75) Inventors: Mohamed Nazmy, Fislisbach (CH); Joachim Roesler, Braunschweig (DE); Alexander Schnell, Ennetbaden (CH); Christoph Toennes, Brugg (CH)

(73) Assignee: ALSTOM Technology LTD, Baden (CH)

( * ) Notice: Subject to any disclaimer, the term of this patent is extended or adjusted under 35 U.S.C. 154(b) by 264 days.

(21) Appl. No.: 10/466,086

(22) PCT Filed: Nov. 5, 2002

(86) PCT No.: PCT/IB02/04617

§ 371 (c)(1),
(2), (4) Date: Jul. 11, 2003

(87) PCT Pub. No.: WO03/040424

PCT Pub. Date: May 15, 2003

(65) Prior Publication Data

US 2004/0050460 A1 Mar. 18, 2004

(30) Foreign Application Priority Data

Nov. 9, 2001 (CH) ..... 2058/01

(51) Int. Cl.
*C22F 1/10* (2006.01)

(52) U.S. Cl. ..... 148/562; 148/675

(58) Field of Classification Search ..... 148/562, 148/675, 677

See application file for complete search history.

(56) References Cited

U.S. PATENT DOCUMENTS

| | | | | |
|---|---|---|---|---|
| 4,459,160 A | | 7/1984 | Meetham et al. | |
| 4,512,817 A | * | 4/1985 | Duhl et al. | 148/522 |
| 4,643,782 A | | 2/1987 | Harris et al. | |
| 4,830,679 A | * | 5/1989 | Yamagata et al. | 148/555 |
| 5,100,484 A | | 3/1992 | Wukusick et al. | |
| 5,154,884 A | | 10/1992 | Wukusick et al. | |
| 5,605,584 A | * | 2/1997 | DeLuca et al. | 148/410 |
| 5,759,301 A | | 6/1998 | Konter et al. | |
| 6,673,308 B1 | * | 1/2004 | Hino et al. | 420/448 |

FOREIGN PATENT DOCUMENTS

| | | |
|---|---|---|
| EP | 0076360 A2 | 4/1983 |
| EP | 0155827 A2 | 9/1985 |
| EP | 0555124 A1 | 8/1993 |
| EP | 0937784 A1 | 8/1999 |
| GB | 2235697 A | 3/1991 |

OTHER PUBLICATIONS

K. Harris et al., Development of Two Rhenium-Containing Superalloys for Single-Crystal Blade and Directionally Solidified Vane Applications in Advanced Turbine Engines, Journal of Materials Engineering & Performance, 1993, pp. 481-487, vol. 2(4), Materials Park, Ohio, USA.

* cited by examiner

*Primary Examiner*—George Wyszomierski
(74) *Attorney, Agent, or Firm*—Buchanan Ingersoll PC

(57) ABSTRACT

In a heat treatment process for a single-crystal or directionally solidified material body comprising a nickel-based superalloy, the material body is solution-annealed and then at a first temperature γ' particles of greater than 1 μm are precipitated in a proportion by volume with $V_{tot}-V_1$ of less than 50%, where $V_{tot}$ is the total amount of γ' particles after complete heat treatment and $V_1$ is the proportion of the γ' particles which is greater than 1 μm, and at least at a second temperature 'γ' particles of less than 1 μm are precipitated. The γ' particles are preferably precipitated in a size of 2 pin or more with a proportion by volume of $0.25<(V_{tot}-V_1)/(100-V_1)<0.55$ at the first temperature. The proportion by volume $V_{tot}$ of the γ' particles will be at least 50%.

8 Claims, 1 Drawing Sheet

HEAT TREATMENT METHOD FOR BODIES THAT COMPRISE A NICKEL BASED SUPERALLOY

TECHNICAL FIELD

The invention relates to a heat treatment process for a single-crystal or directionally solidified material body comprising a nickel-based superalloy.

PRIOR ART

Nickel-based superalloys, as are known, for example, from U.S. Pat. No. 5,759,301, are subjected to a heat treatment using the casting process. In this case, in a first solution-annealing step the γ' phase which has precipitated nonuniformly during the casting process is completely or partially dissolved. In a second precipitation heat treatment, this γ' phase is precipitated again under controlled conditions. To achieve optimum mechanical properties, this precipitation heat treatment is carried out in such a manner that fine, uniformly distributed γ' particles are precipitated.

A heat treatment of this type is known from the article *Development of two Rhenium-containing superalloys for single crystal blade and directionally solidified vane applications in advanced turbine engines, Journal of Materials Engineering and Performance,* 2(1993)August, No. 4, Materials Park, Ohio, US. In this case, the material CMSX-4 is subjected to a two-stage heat treatment which firstly provides for γ' particles with a mean size of 0.45 μm to be precipitated at a temperature of 1140° C., before a second fraction of ultrafine γ' particles with a size in the nanometer range is precipitated at a temperature of 871° C. Similar heat treatment for the precipitation of γ' particles in nickel-based superalloys are disclosed by the documents GB-A-2 235 697, EP-A2-155 827, U.S. Pat. No. 5,100,484, U.S. Pat. No. 4,459,160 and U.S. Pat. No. 4,4643,782.

EP-A2-76 360, U.S. Pat. No. 5,154,884 and EP-A1-937 784 have likewise disclosed heat treatments of this type. These documents provide for precipitation heat treatments at various temperatures in order to precipitate γ' particles of different sizes. By way of example, in EP-A1-76 360, a first phase of "coarse" γ' particles is precipitated at a temperature of 1204° to 1260° C. over a period of 2 to 4 hours. Then, a second phase of "fine" γ' particles is precipitated at a temperature of 1080° C. In a final step, a heat treatment is carried out at 649° C.

When there is a mechanical load and prolonged high-temperature load, the result is directional coarsening of the γ' particles, a phenomenon known as rafting, and, with high γ' contents (i.e. if the proportion by volume of γ' is at least 50%), the microstructure is inverted, i.e. γ' becomes the continuous phase in which the previous γ' matrix is embedded. Since the intermetallic γ' phase has a tendency toward environment embrittlement, under certain load conditions this leads to a huge loss of mechanical properties. Environment embrittlement occurs in particular if moisture and long holding times under a tensile load are present.

SUMMARY OF THE INVENTION

The invention is based on the object of providing a heat treatment process of the type described in the introduction which, in a simple manner, allows the described embrittlement and the associated loss of properties in nickel-based superalloys with a high γ' content of 50% and above to be avoided.

According to the invention, in a heat treatment process, this is achieved by the fact that, at a first temperature $T_1$, γ' particles of larger than 1 μm are precipitated in a proportion by volume of $V_{tot}-V_1$ of less than 50%, where $V_1$ is the proportion of the γ' particles which is larger than 1 μm, and, at least at a second temperature $T_A$, γ' particles of less than 1 μm are precipitated. The γ' particles are preferably precipitated in a size of 2 μm or more with a proportion by volume of $0.25<(V_{tot}-V_1)/(100-V_1)<0.55$ at the first temperature.

With a material having a composition of (% by weight) Ni—6.5% Cr—9.6% Co—0.6% Mo—6.4% W—6.5% Ta—3% Re—5.6% Al—1.0% Ti—0.2 Hf—230 ppm C—70 ppm B, the precipitation of γ' particles of greater than 1 μm is carried out a temperature $T_1$ of between 1180° C. and 1275° C., preferably at a temperature $T_1$ of between 1230° C. and 1265° C., over a period of between 1 and 10 hours.

The precipitation of γ' particles of less than 1 μm is carried out a temperature $T_{A1}$ of 1050° to 1150° C. over the course of 1 to 10 hours and a temperature $T_{A2}$ of 820° to 900° C. over the course of 10 to 30 hours.

Cooling from the solution-annealing temperature to the first precipitation temperature for precipitation of coarse γ' particles with a particle size of greater than 1 μm is advantageously carried out with a cooling rate of less than 5 K/min, preferably between 2 K/min and 0.1 K/min, preferably of 0.5 K/min. Alternatively, between the solution-annealing and the precipitation of coarse γ' particles, the material body can be cooled to room temperature and then reheated to the first temperature $T_1$.

BRIEF DESCRIPTION OF THE FIGURES

The invention is explained in more detail in the appended figures, in which.

Figure 1:
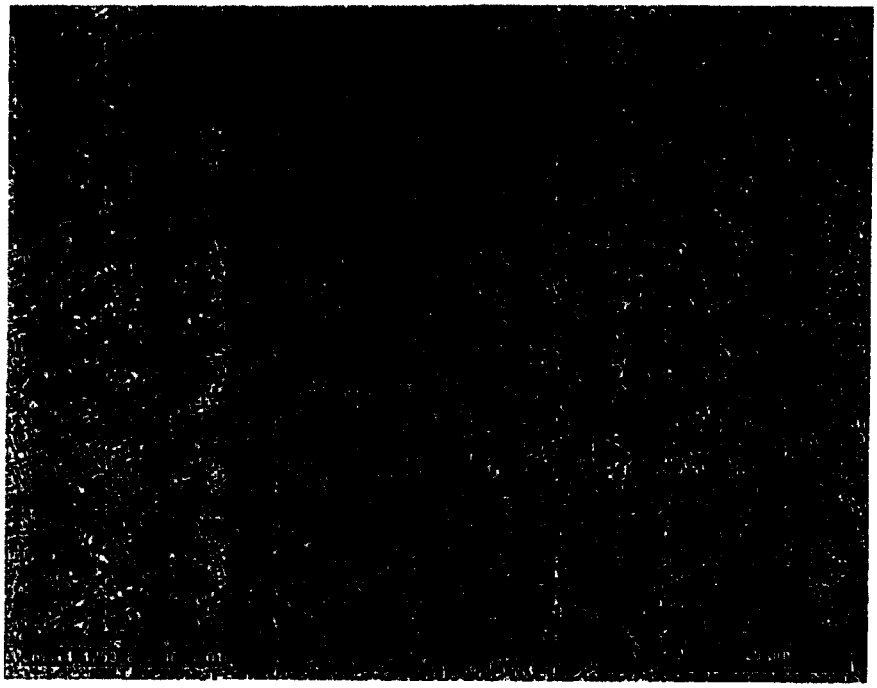
FIG. 1 shows a material body which has been heat-treated using variant 1 in accordance with the invention.

Only the elements which are pertinent to the invention are shown.

WAYS OF CARRYING OUT THE INVENTION

The present invention relates to a heat treatment process for a single-crystal or directionally solidified material body which consists of a nickel-based superalloy with a volumetric γ' content $V_{tot}$ after complete heat treatment of at least 50%. A nickel-based superalloy of this type is known, for example, from U.S. Pat. No. 5,759,301. This may, for example, be a thermally loaded component, such as for example a guide vane or rotor blade of a gas turbine.

In a first step, the material body is solution-annealed at a temperature $T_L$ in order to virtually completely dissolve the γ' particles in accordance with the prior art. This first step is used to completely or partially dissolve the γ' phase, which has been precipitated nonuniformly during the casting process. In a further heat treatment, these γ' particles are then precipitated again, but with a uniform distribution.

According to the invention, this γ' phase is precipitated at various temperatures and therefore in various sizes. The mean particle diameter of a "coarse" γ' phase which is precipitated first of all at a temperature $T_1$ must be greater than 1 μm, preferably greater than 2 μm. One qualitative feature is the irregular morphology of these γ' particles, which results from the fact that the particles at least partially lose their coherency with respect to the matrix. If $V_{tot}$ is the total volumetric proportion of γ' which can be precipitated, i.e. for example 70%, and $V_1$ is the first proportion, which is to be precipitated in coarse form, of the γ' particles, $V_{tot}-V_1$ must be less than 50%. Furthermore, the following relationship should preferably be satisfied: $0.25<(V_{tot}-V_1)/(100-V_1)<0.55$. These relationships should be satisfied throughout the entire volume of the material, i.e. in the dendritic and interdendritic regions. This relationship leads to a large interparticle spacing of the "coarse" γ' phase, which increases the diffusion distance and thereby prevents rafting in this phase.

Furthermore, if the upper limit of $V_{tot}-V_1$ less than 50% or $(V_{tot}-V_1)/(100-V_1)<0.55$) is maintained, the proportion of fine γ' particles of less than 1 μm is reduced to such an extent that the loss of certain mechanical properties caused by environmental embrittlement described in the introduction no longer occurs, since the proportion by volume of these particles is no longer sufficient to cause matrix inversion. The preferred lower limit of $0.25<(V_{tot}-V_1)/(100-V_1)$ results from the fact that the strength values have to achieve a certain minimum level through the presence of a sufficient proportion by volume of fine γ' particles.

Furthermore, in a second precipitation heat treatment at temperature $T_A<T_1$, γ' particles of less than 1 μm are precipitated. This may also take place at two temperatures $T_{A1}$ and $T_{A2}$ in order to further precipitate γ' particles in the range of a few tens of nanometers.

Furthermore, it is proposed to introduce a cooling rate v of less than 5 K/min from the solution-annealing temperature $T_L$ to the precipitation temperature $T_1$. This promotes the desired establishment of a coarse γ' microstructure, since slow cooling leads to a low density of γ' nuclei. A lower limit is determined only by cost reasons based on increasing heat treatment times. The cooling rate v is preferably between 0.1 K/min and 2 K/min, with a preferred value of 0.5 K/min.

As an alternative to the abovementioned slow cooling, cooling from $T_L$ to room temperature by means of gas cooling (gas fan quenching) with subsequent reheating to $T_1$ is also conceivable. In this case, cooling rates of at least 20 K/min are typically achieved. $T_1$ and the heat treatment duration can once again be defined in accordance with the criteria classified above with regard to mean diameter and volumetric proportion of the coarse precipitations.

Experimental Results

The experimental results relate to the material MK4 of the following composition (% by weight) Ni—6.5% Cr—9.6% Co—0.6% Mo—6.4% W—6.5% Ta—3% Re—5.6% Al—1.0% Ti—0.2 Hf—230 ppm C—70 ppm B.

Variant 1 of the Heat Treatment According to the Invention

Solution annealing at $T_L$=1300° C./2.5 h and 1310° C./6 h

Cooling at 0.5 K/min to $T_1$=1250° C.

Annealing at $T_1$=1250° C./6 h

Gas cooling to room temperature with a cooling rate of more than 20 K/min

Precipitation heat treatment at $T_{A1}$=1140° C./6 h and $T_{A2}$=870° C./20 h.

Variant 2 of the Heat Treatment According to the Invention

Solution annealing at $T_L$=1300° C./4 h

Cooling with furnace cooling (1–3 K/min) to $T_1$=1200° C.

Annealing at $T_1$=1200° C./6 h

Gas cooling to room temperature with a cooling rate of 10 to 30 K/min

Precipitation heat treatment at $T_{A1}$=1110° C./6 h and $T_{A2}$=760° C./16 h.

The present results demonstrate that the inventive purpose, that of substantially avoiding environmental embrittlement after a high-temperature mechanical load has been present, is achieved. FIG. 1 shows the microstructure after complete heat treatment. The presence of a bimodal γ' particle distribution is clearly visible after complete heat treatment, the coarse γ' particle fraction being characterized by a mean diameter of greater than 1 μm and an irregular morphology.

Table 1 shows characteristic values determined in a tensile test in which a heat treatment in accordance with Variants 1 and 2 were selected. For comparison purposes, the table also includes values for which the annealing at 1250° C. was omitted from the heat treatment and there was an absence of slow cooling between the solution annealing and the precipitation heat treatment (designated "conventional"). In addition, tensile tests have been carried out in which the material was exposed to previous creep preshaping at high temperatures ("degraded" material state). The creep test for the material with the heat treatment in accordance with the invention was carried out at 1050° C. and 120 MPa for 285 h. The result was a creep elongation of 3.2%.

TABLE 1

| Heat treatment | Material state | Drawing rate [mm/min] | T [° C.] | $R_{p0.2}$ [MPa] | $R_m$ [MPa] | Elongation at break [%] |
|---|---|---|---|---|---|---|
| Variant 1 | Invention | 1 | RT | 639 | 660 | 18.4 |
| Variant 1 | Invention | 1 | 700 | 725 | 734 | 22.4 |
| Variant 1 | Invention, "degraded" | 0.0005 (humid environment) | RT | 526 | >561 | >21.4 |
| Variant 1 | Invention, "degraded" | 1 | 700 | 591 | 639 | 42.2 |
| Variant 2 | Invention | 1 | RT | 811 | 917 | 7.6 |
| Variant 2 | Invention, "degraded" | 0.0005 (humid environment) | RT | 623 | 946 | 17.83 |
| | Conventional | 1 | RT | 910 | 986 | |
| | Conventional | 1 | 700 | 956 | 1114 | |
| | Conventional, | 0.0005 | RT | 639 | 660 | Brittle |

TABLE 1-continued

| Heat treatment | Material state | Drawing rate [mm/min] | T [° C.] | $R_{p0.2}$ [MPa] | $R_m$ [MPa] | Elongation at break [%] |
|---|---|---|---|---|---|---|
| | "degraded" | (humid environment) | | | | fracture |
| | Conventional, "degraded" | 1 | 700 | 725 | 734 | |

It is noticeable that the tensile strength drops significantly after the heat treatment according to the invention compared to MK4 in a conventional heat treatment. After aging, as typically occurs in operation, however, the difference is significantly less, and consequently this can also be considered acceptable.

Carrying out the tensile test at a drawing rate of 0.0005 mm/min in a humid environment after the creep deformation mentioned above was interrupted at a plastic elongation of 21.4% without specimen fracture, which indicates that, unlike with the conventional heat treatment, there is no embrittlement. In the comparable specimen at room temperature for MK4 at a drawing rate of 0.0005 mm/min after prior creep deformation at 1050° C./120 MPa up to 1% plastic deformation, the specimen experiences brittle fracture without plastic deformation. A rafting structure with matrix inversion is formed.

Of course, other mechanical properties should not be reduced to an unacceptable extent by the heat treatment according to the invention.

Fatigue tests at 900° C. with a holding time of 10 min at the maximum compressive strain and $\Delta\epsilon$=0.8%; $R_\epsilon$=−1.

The specimen reached 1300 cycles without fracturing. For comparison purposes, the mean and minimum for MK4 with a conventional heat treatment are approx. 2500 and 1000 cycles, respectively. This demonstrates that the fatigue performance approximately corresponds to that of MK4 which has been heat treated conventionally.

Creep test at 1050° C./120 MPa up to a creep elongation of 3.2% after 285 hours. This result approximately corresponds to the minimum values for MK4 heat treated conventionally. In this case too, therefore, there is no unacceptably high loss of properties.

Variant 3 of the Heat Treatment

Solution annealing at $T_L$=1300° C./2.5 h and 1310° C./6 h

Cooling at 0.5 K/min to $T_1$=1275° C.

Annealing at $T_1$=1275° C./6 h

Gas cooling to room temperature at a cooling rate of more than 20 K/min

Precipitation heat treatment at $T_{A1}$=1140° C./6 h and $T_{A2}$=870° C./20 h.

Figure 2:
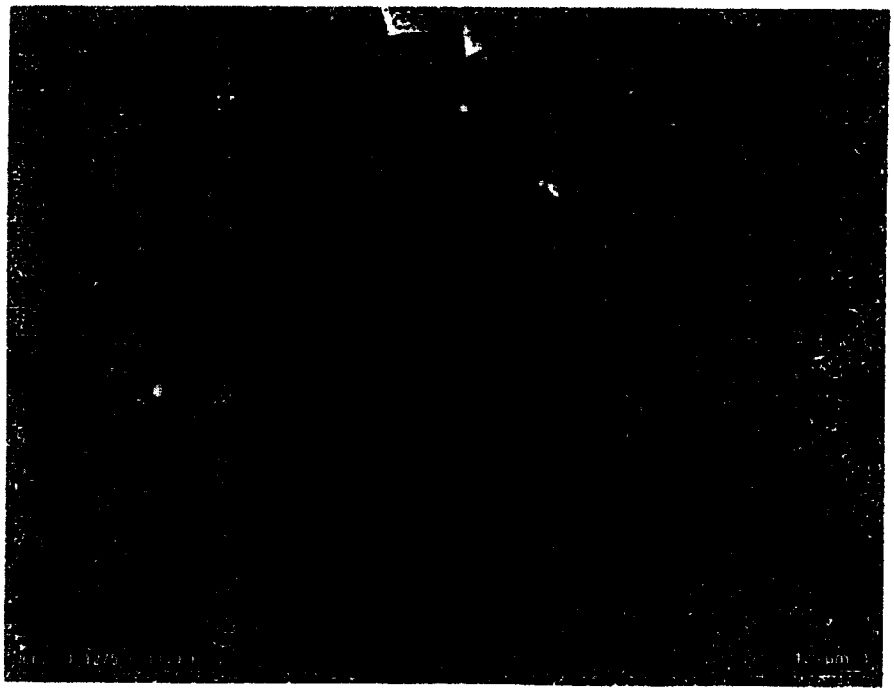
FIG. 2 shows a material body which has been heat treated using variant 3, which does not correspond to the invention.

As can be seen from FIG. 2, the precipitation heat treatment resulted in the coarse γ' particles not being established in the dendrite cores at $T_1$=1275° C. for the material MK4 with $V_{tot}$ of approx. 70%. This is less favorable, since as a result not all regions of the material are effectively protected from the embrittlement phenomenon described above. Consequently, this temperature was no longer taken into account for the further experimental data. In concrete terms, what this means is that $T_1$=1275° C. is already too high, since no coarse γ' precipitations have formed in the dendrite cores.

Variant 4 of the Heat Treatment

Solution annealing at $T_L$=1300° C./2.5 h and 1310° C./6 h

Cooling at 0.5 K/min to $T_1$=1180° C.

Annealing at $T_1$=1180° C./6 h

Gas cooling to room temperature at a cooling rate of more than 20 K/min

Precipitation heat treatment at $T_{A1}$=1140° C./6 h and $T_{A2}$=870° C./20 h.

With a precipitation heat treatment at $T_1$=1180° C., coarse γ' particles were formed throughout. However, the subsequent heat treatment at $T_A$ only leads to a certain amount of precipitation of fine γ' particles. There is therefore only a certain extent of a bimodal microstructure. Therefore $T_1$=1180° C. is too low, since practically the entire precipitation volume is in the form of a coarse phase, and the finer particle fraction is required in order to ensure that sufficient strength is achieved.

Therefore, for the material MK4 used, there is a temperature window between 1180° C. and 1275° C., with a preferred range from 1230° C. to 1265° C.

LIST OF REFERENCE SYMBOLS $T_L$ Solution-annealing temperature
$T_1$ Precipitation temperature of the "coarse" γ' phase
$T_A$ Precipitation temperature of a "fine" γ' phase
$T_{A1}$ Precipitation temperature of a first "fine" γ' phase
$T_{A2}$ Precipitation temperature of a second "fine" γ' phase
v Cooling rate
$V_{tot}$ Volumetric content of the total γ' phase
$V_1$ Volumetric content of the "coarse" γ' phase

The invention claimed is:

1. A heat treatment process for a single-crystal or directionally solidified material body comprising a nickel-based superalloy with a volumetric γ' content $V_{tot}$ after complete heat treatment of at least 50%, the material body being solution-annealed and then γ' particles being precipitated in various sizes at different temperatures wherein, at a first temperature, γ' particles of larger than 1 μm are precipitated in a proportion by volume of $V_{tot}-V_1$ of less than 50%, where $V_1$ is the proportion of the γ' particles which is larger than 1 μm, and, at least at a second temperature, γ' particles of less than 1 μm are precipitated, wherein the precipitation of γ' particles of greater than 1 μm in a material with a composition of (% by weight) Ni—6.5% Cr—9.6% Co—0.6% Mo—6.4% W—6.5% Ta—3% Re—5.6% Al—1.0% Ti—0.2 Hf—230 ppm C—70 ppm B is carried out a temperature of between 1180° C. and 1275° C.

2. The heat treatment process as claimed in claim 1, wherein first of all γ' particles of greater than 2 μm are precipitated in a proportion by volume of $0.25<(V_{tot}-V_1)/(100-V_1)<0.55$.

3. The heat treatment process as claimed in claim 1, wherein the precipitation of γ' particles of less than 1 μm is carried out at a temperature ($T_{A1}$) of 1050° to 1150° C. over the course of 1–10 hours and a temperature ($T_{A2}$) of 820° to 900° C. over the course of 10 to 30 hours.

4. The heat treatment process as claimed in claim 1, wherein a cooling rate of less than 5 K/min is selected between the solution annealing and the precipitation of coarse γ' particles at the first temperature.

5. The heat treatment process as claimed in claim 4, wherein a cooling rate of between 2 K/min and 0.1 K/min is selected between the solution annealing and the precipitation of coarse γ' particles.

6. The heat treatment process as claimed in claim 5, wherein a cooling rate of 0.5 K/min is selected between the solution annealing and the precipitation of coarse γ' particles.

7. The heat treatment process as claimed in claim 1, wherein between the solution annealing and the precipitation of coarse γ' particles the material body is cooled to room temperature and is then reheated to the first temperature.

8. A heat treatment process for a single-crystal or directionally solidified material body comprising a nickel-based superalloy with a volumetric γ' content $V_{tot}$ after complete heat treatment of at least 50%, the material body being solution-annealed and then γ' particles being precipitated in various sizes at different temperatures wherein, at a first temperature, γ' particles of larger than 1 μm are precipitated in a proportion by volume of $V_{tot}-V_1$ of less than 50%, where $V_1$ is the proportion of the γ' particles which is larger than 1 μm, and, at least at a second temperature, γ' particles of less than 1 μm are precipitated, wherein the precipitation of γ' particles of greater than 1 μm in a material with a composition of (% by weight) Ni—6.5% Cr—9.6% Co—0.6% Mo—6.4% W—6.5% Ta—3% Re—5.6% Al—1.0% Ti—0.2. Hf—230 ppm C—70 ppm B is carried out a temperature of between 1230° C. and 1265° C. over a period of between 1 and 10 hours.

* * * * *